US008056209B2

(12) United States Patent
Michalsky

(10) Patent No.: US 8,056,209 B2
(45) Date of Patent: Nov. 15, 2011

(54) TUBULAR, ESPECIALLY CAN-SHAPED, RECEPTACLE FOR THE ACCOMMODATION OF FLUIDS, A METHOD OF MANUFACTURE AND USE

(75) Inventor: Andreas Michalsky, Memmingen (DE)

(73) Assignee: Zweigniederlassung der Huhtamaki Deutschland, GmbH & Co. KG, Ronsberg-Allgau (DE)

( * ) Notice: Subject to any disclaimer, the term of this patent is extended or adjusted under 35 U.S.C. 154(b) by 0 days.

(21) Appl. No.: 12/099,730

(22) Filed: Apr. 8, 2008

(65) Prior Publication Data

US 2008/0184548 A1 Aug. 7, 2008

Related U.S. Application Data

(62) Division of application No. 10/856,421, filed on May 27, 2004, now Pat. No. 7,364,047.

(51) Int. Cl.

| | |
|---|---|
| ***B23P 17/00*** | (2006.01) |
| *B65D 1/40* | (2006.01) |
| *B65D 3/22* | (2006.01) |
| *B65D 8/04* | (2006.01) |

(52) U.S. Cl. ..... 29/527.4; 29/428; 29/527.2

(58) Field of Classification Search ..... 220/62.12, 220/62.22, 678, 703; 29/527.4, 527.2, 428; 53/432

See application file for complete search history.

(56) References Cited

U.S. PATENT DOCUMENTS

| | | | | |
|---|---|---|---|---|
| 360,993 | A * | 4/1887 | Brown | 29/458 |
| 1,434,460 | A * | 11/1922 | Tibbatts | 220/4.26 |
| 2,084,973 | A * | 6/1937 | John | 220/274 |
| 2,348,696 | A * | 5/1944 | Schabacker | 156/69 |
| 2,370,226 | A | 2/1945 | Brede | |
| 2,384,324 | A * | 9/1945 | Martin | 29/458 |
| 2,401,231 | A * | 5/1946 | Crawford | 220/567.3 |
| 2,490,978 | A * | 12/1949 | Osterheld | 204/196.15 |
| 2,626,647 | A | 1/1953 | Barton | |
| 2,847,151 | A | 8/1958 | Meyer-Jagenberh | |
| 3,128,913 | A | 4/1964 | Specketer | |
| 3,217,951 | A | 11/1965 | Paal | |
| 3,291,377 | A | 12/1966 | Eggen | |
| 3,313,333 | A | 4/1967 | Lordi | |
| 3,317,110 | A | 5/1967 | Palmer | |

(Continued)

FOREIGN PATENT DOCUMENTS

| | | |
|---|---|---|
| AT | 293944 | 10/1971 |

(Continued)

OTHER PUBLICATIONS

Allcock, Harry R., "Contemporary Polymer Chemistry"—1990, Prentice Hall, second edition, p. 34, 1990.

*Primary Examiner* — Essama Omgba

(74) *Attorney, Agent, or Firm* — Knobbe Martens Olson & Bear LLP

(57) ABSTRACT

Tubular, especially can-shaped, receptacle for the accommodation of fluids, especially drinks, with a tubular body and a base and top section attached to this, wherein the top section is constructed in the shape of a shoulder and is suitable for attaching a closure device, especially a resealable one. The shoulder-shaped top section is at least partially enclosed, especially in the shape of a shoulder, by an upper edge of the tubular body and sealed with this.

8 Claims, 1 Drawing Sheet

U.S. PATENT DOCUMENTS 3,396,899 A 8/1968 Strouse et al.
D214,023 S 5/1969 Beaumont
3,519,158 A 7/1970 Anderson
3,548,564 A 12/1970 Bruce et al.
3,604,491 A 9/1971 Spiess
3,608,709 A 9/1971 Pike et al.
3,690,524 A 9/1972 Haberhauer
3,832,964 A 9/1974 Rockefeller
3,935,993 A 2/1976 Doyen et al.
3,937,396 A 2/1976 Schieder
3,997,677 A 12/1976 Hirsch et al.
4,091,929 A 5/1978 Krane et al.
4,116,359 A 9/1978 Josephy
4,132,331 A * 1/1979 Magerle ..... 222/107
4,194,641 A * 3/1980 Gaiser ..... 215/398
4,210,674 A 7/1980 Mitchell
4,216,268 A 8/1980 Stillman
4,241,130 A 12/1980 Barnes
4,252,238 A 2/1981 Spiegelberg
4,262,819 A * 4/1981 Hayes ..... 222/92
4,304,038 A * 12/1981 Yabu et al. ..... 29/458
4,310,162 A * 1/1982 Donovan ..... 277/628
4,337,862 A 7/1982 Suter et al.
4,353,497 A 10/1982 Bustin
4,428,477 A 1/1984 Cristofolo
4,471,882 A 9/1984 Joo
4,519,859 A * 5/1985 Roth et al. ..... 156/69
4,526,287 A 7/1985 Miyamatsue et al.
4,541,546 A 9/1985 Imazu et al.
4,568,001 A * 2/1986 Sander ..... 222/107
4,572,377 A 2/1986 Beckett
4,606,462 A 8/1986 Bogren et al.
4,659,408 A 4/1987 Redding
4,709,397 A 11/1987 Voshall et al.
4,775,098 A 10/1988 Peer, Jr.
4,779,998 A 10/1988 Wischusen, III
4,792,061 A * 12/1988 Nishida ..... 222/107
4,834,247 A 5/1989 Oshima et al.
4,890,744 A 1/1990 Lane, Jr. et al.
D311,488 S 10/1990 Regenscheid
4,978,015 A * 12/1990 Walker ..... 215/375
4,983,431 A 1/1991 Gibbons et al.
4,986,053 A 1/1991 Schaefer
4,997,661 A 3/1991 Kromer et al.
5,009,364 A 4/1991 Bolte
5,024,044 A 6/1991 Friedrich et al.
5,041,180 A * 8/1991 Makilaakso ..... 156/69
5,098,794 A 3/1992 Schaefer
5,114,766 A 5/1992 Jacques
5,205,651 A 4/1993 Decottignies et al.
5,217,164 A 6/1993 Sullivan et al.
5,263,606 A 11/1993 Dutt et al.
5,284,540 A 2/1994 Roth et al.
5,350,240 A 9/1994 Billman et al.
5,409,115 A 4/1995 Barkhorn
5,460,838 A 10/1995 Wermund
5,493,844 A 2/1996 Combrink
5,587,192 A 12/1996 Beizermann
5,622,432 A 4/1997 Zicker
5,647,500 A 7/1997 Konno et al.
5,823,383 A 10/1998 Hins
5,885,673 A 3/1999 Light et al.
5,913,449 A 6/1999 Branch et al.
5,939,153 A 8/1999 Valyi
5,945,145 A 8/1999 Narsutis et al.
6,000,848 A 12/1999 Massioui
6,004,638 A * 12/1999 Kaya et al. ..... 428/35.7
6,050,451 A 4/2000 Hess, III et al.
6,076,664 A 6/2000 Yeager et al.
6,123,211 A 9/2000 Rashid et al.
6,199,698 B1 3/2001 Hetrick et al.
6,220,310 B1 * 4/2001 Emmer ..... 141/51
6,226,964 B1 5/2001 Vettorato
6,231,237 B1 5/2001 Geller
6,261,215 B1 7/2001 Imer
6,270,867 B1 8/2001 Eckstein et al.
6,276,546 B1 * 8/2001 Davis et al. ..... 215/375
6,279,297 B1 8/2001 Latronico
6,287,658 B1 9/2001 Cosentino et al.
6,334,710 B1 1/2002 Kuge et al.
6,399,014 B1 6/2002 Hermodsson
6,436,497 B1 * 8/2002 Takahashi et al. ..... 428/35.7
6,436,499 B1 8/2002 Krampe et al.
6,478,190 B2 11/2002 Kuge et al.
D476,565 S 7/2003 Rosen
6,681,950 B2 * 1/2004 Miller et al. ..... 220/495.11
6,783,277 B2 8/2004 Edwards et al.
6,929,400 B2 8/2005 Razeti et al.
6,938,805 B2 9/2005 Brincat
D510,277 S 10/2005 Bennie et al.
7,034,268 B2 4/2006 Hopkins, Sr. et al.
7,105,788 B2 9/2006 Hopkins
7,115,309 B2 10/2006 Akiyama et al.
7,364,047 B2 * 4/2008 Michalsky ..... 220/62.12
7,543,990 B2 6/2009 Michalsky
7,743,962 B2 * 6/2010 Le Cocq et al. ..... 228/124.6
2001/0042757 A1 11/2001 Kuge et al.
2002/0112982 A1 8/2002 Stagray et al.
2002/0162863 A1 11/2002 Brincat
2002/0182351 A1 12/2002 Akiyama et al.
2003/0059130 A1 3/2003 Youneyama et al.
2003/0077010 A1 4/2003 Schulz
2003/0144122 A1 7/2003 Post et al.
2003/0173363 A1 * 9/2003 Miller et al. ..... 220/495.11
2004/0052987 A1 3/2004 Shetty et al.
2004/0238475 A1 * 12/2004 Peronek ..... 215/40
2005/0041888 A1 2/2005 Matsuzawa et al.
2006/0201903 A1 * 9/2006 Peronek ..... 215/40

FOREIGN PATENT DOCUMENTS

CA 2342504 A1 10/2001
CH 669 563 A5 3/1989
DE 1 723 470 5/1956
DE 1 757 066 11/1957
DE 8810 166 U1 5/1969
DE 2 000 532 A1 7/1971
DE 2 100 833 7/1971
DE 31 06 692 A1 9/1972
DE 25 26 975 A1 12/1976
DE 2644209 A1 5/1977
DE 25 56 230 A1 7/1977
DE 3208625 A1 10/1982
DE 3329533 3/1985
DE 37 09 867 C2 3/1987
DE 29 04 847 8/1990
DE 91 07 722.2 8/1991
DE 40 23 602 A1 1/1992
DE 3877718 T2 5/1993
DE 43 038 94 A1 8/1994
DE 4429148 A1 2/1996
DE 19 581 417 4/1996
DE 19548173 A1 6/1997
DE 1 786 019 11/1997
DE 69407954 T2 6/1998
DE 198 28 178 9/1999
DE 299 20 874 U1 2/2000
DE 198 60 473 A1 6/2000
DE 202 12 251 U1 1/2003
DE 202 14 197 U1 1/2003
DE 10238965 8/2003
DE 102 21 432 12/2003
DE 203 12 111 U1 12/2003
DE 202 15 255 U1 2/2004
DE 20215255 2/2004
DE 102 57 145 6/2004
DE 102004023023 A1 12/2005
DE 102004042968 A1 3/2006
EP 0 078 761 5/1983
EP 0 153 987 A 9/1985
EP 0 182 416 A 5/1986
EP 0 203 612 A2 5/1986
EP 0321172 A2 6/1989
EP 0 324 260 7/1989
EP 0 333 443 9/1989
EP 0 360 737 A 3/1990
EP 0 379 136 7/1990
EP 0 446 005 9/1991

| | | | |
|---|---|---|---|
| EP | 0 521 642 | A | 1/1993 |
| EP | 0 537 109 | A2 | 4/1993 |
| EP | 0684184 | | 11/1995 |
| EP | 0595587 | | 2/1997 |
| EP | 0 772 522 | | 5/1997 |
| EP | 0 785 148 | A | 7/1997 |
| EP | 0 661 219 | B1 | 3/2000 |
| EP | 1 029 794 | A | 8/2000 |
| EP | 1 086 906 | A | 3/2001 |
| EP | 1151934 | | 11/2001 |
| EP | 1174360 | | 1/2002 |
| EP | 0 976 539 | | 2/2002 |
| EP | 0833774 | B1 | 8/2002 |
| EP | 1064150 | B1 | 10/2002 |
| EP | 1 331 174 | | 7/2003 |
| EP | 1 362 797 | A2 | 11/2003 |
| EP | 1362797 | A2 | 11/2003 |
| EP | 1 508 531 | A | 2/2005 |
| EP | 1512637 | | 3/2005 |
| EP | 1621477 | | 2/2006 |
| FI | 109193 | B | 2/2000 |
| FR | 2 487 805 | A | 2/1982 |
| FR | 2 577 897 | A | 8/1986 |
| FR | 2 729 366 | | 7/1995 |
| FR | 2 859 182 | A | 3/2005 |
| GB | 1 298 790 | A | 12/1972 |
| GB | 2 254 594 | A | 10/1992 |
| GB | 2257943 | A | 1/1993 |
| GB | 2 188 520 | A | 9/1997 |
| JP | 10 152146 | A | 6/1998 |
| JP | 2000006999 | | 1/2000 |
| JP | 2000-211675 | | 8/2000 |
| JP | 2001080650 | A | 3/2001 |
| JP | 2000 335630 | A | 4/2001 |
| JP | 2001-176461 | | 6/2001 |
| JP | 2001-176463 | | 6/2001 |
| JP | 2002-104446 | | 4/2002 |
| KR | 10-0274821 | | 9/2000 |
| NL | 6 810 059 | A | 7/1969 |
| RU | 2139824 | C1 | 10/1999 |
| WO | WO 94/23945 | | 10/1994 |
| WO | WO 96/03281 | | 2/1996 |
| WO | WO 96/21599 | A | 7/1996 |
| WO | WO 98/02305 | A1 | 1/1998 |
| WO | WO 99/46120 | A1 | 9/1999 |
| WO | WO 99/64227 | | 12/1999 |
| WO | WO 00/00396 | | 1/2000 |
| WO | WO 00/12387 | | 3/2000 |
| WO | WO 00/49908 | | 8/2000 |
| WO | WO 00/50314 | | 8/2000 |
| WO | WO 01/83212 | A | 11/2001 |
| WO | WO 02/055402 | | 7/2002 |
| WO | WO 02/055405 | | 7/2002 |
| WO | WO 03/018420 | A | 3/2003 |
| WO | WO 03/097479 | | 11/2003 |
| WO | WO 2004/101374 | A | 11/2004 |
| WO | WO 2005/105600 | | 11/2005 |
| WO | WO 2006/000820 | | 1/2006 |
| WO | WO 2007/042174 | A1 | 4/2007 |

* cited by examiner

TUBULAR, ESPECIALLY CAN-SHAPED, RECEPTACLE FOR THE ACCOMMODATION OF FLUIDS, A METHOD OF MANUFACTURE AND USE

CROSS REFERENCE TO RELATED APPLICATIONS

This application is a divisional of U.S. application Ser. No. 10/856,421, filed on May 27, 2004, the entire disclosure of which is hereby incorporated by reference.

BACKGROUND OF THE INVENTION

1. Field of the Invention

The invention concerns a tubular, especially can-shaped, receptacle for the accommodation of fluids, a method of manufacture, and a use of the receptacle.

2. Description of the Related Art

A large number of tubular receptacles are known from the prior art. These normally serve to accommodate pastes, creams, gels and fluids. The tubular receptacles are usually tube-shaped, though in recent times they are also can-shaped. DE 32 08 625 A1 and DE 44 29 148 A1 describe processes for manufacturing and filling such tubes. JP 2001 080 650 A describes a pouch-shaped receptacle with a base. A can-shaped tubular receptacle is described, for instance, in WO 99/64227. A series of other can-shaped tubular receptacles can be found in the publications EP 0 595 587 B1, EP 0 833 774 B1, WO 00/00396 and F1 109 193 B.

All these tubular receptacles described in the publications have certain disadvantages, especially with regard to their use. Use is therefore restricted and only possible for select products. Thus bag-type packaging, and tubes especially, have only limited use or are not suitable at all to accommodate fluids. In addition, tubes have no base that can serve as a standing surface. Another essential disadvantage, which all the aforementioned tubular receptacles have in common, consists in the fact that the said receptacles are not suitable for accommodating, and especially storing and transporting, nor for deliberately dispensing, drinks, especially carbonated drinks.

Hitherto, bottles and cans made out of aluminum or tinplate have normally been used for this purpose. These do have a high degree of impermeability, especially pressure tightness, and with that the facility for storing fluids that are under excess pressure. However, they are both expensive to manufacture and disadvantageous in terms of their weight and disposal.

SUMMARY OF THE INVENTION

One aim of the invention is to provide a tubular, especially can-shaped, receptacle for the accommodation of fluids, which is suitable for accommodating and storing fluids that are under slight excess pressure, such as carbonated drinks.

The aim may be achieved by a tubular, especially can-shaped, receptacle for the accommodation of fluids, especially drinks, with a tubular body and a base and top section attached to this, wherein the top section is constructed in the shape of a shoulder and is suitable for attaching a closure device, especially a resealable one.

One aspect of the invention ties in the fact that the top section is constructed in the shape of a shoulder. This makes it possible, on the one hand, to lay the top section flat against the circumferential tubular body and to seal it to it. On the other hand, the shoulder-shaped construction may create a junction with a closure device, which has an increased pressure-bearing capacity vis-à-vis the prior art. The shoulder-shaped construction of the top section also provides, compared with a level top section, a greater contact area both with the tubular body and for attaching a closure device. As a result, there is a greater sealing surface available between the shoulder-shaped top section and the tubular body, as well as between the shoulder-shaped top section and the closure device, thereby achieving an increase in stability and thus in the compressive strength of the receptacle.

The closure device is preferably constructed to be resealable, making it possible to remove only part-quantities of the volume from the tubular receptacle and to then close this again after removal. The closure device is preferably constructed in such a way that any excess pressure that is present can be reduced in a slow and controlled manner, say by means of a screw-type closure.

In one embodiment of the invention, the shoulder-shaped top section is at least partially enclosed, especially in the shape of a shoulder, by an upper edge of the tubular body and sealed with this. This embodiment has the decisive advantage that any excess pressure present or developing in the tubular receptacle helps to stabilize seal seams in a shoulder area. The excess pressure works on this occasion on the inner surface of the shoulder-shaped top section, pressing the top section against the edge of the tubular body enclosing the shoulder-shaped top section. The tubular body is preferably made of a flexible material. This, however, has an intrinsic firmness, possibly including a fabric or metallic or similar interlining, with the result that a shoulder of the top section may be pressed against a shoulder of the tubular body. A seal located in this area between the top section and the tubular body is consequently further reinforced by the added exertion of an inner pressure in the tubular receptacle, which in turn creates an additional sealing effect.

In some embodiments, the base section may be constructed as an especially dimensionally stable round section and may be sealed with a lower edge of the tubular body. In particular, the base section may be enclosed in a ring by the lower edge of the tubular body and sealed with this. The tubular body has according to one embodiment a round "standing surface", into which the base section is inserted and which, with respect to its shape, essentially corresponds to the circumferential shape of the base section. It is also possible that the tubular body is constructed with one or more corners or is oval. In each case the shape of the base section is adapted to the shape of the standing surface, the result being that the base section can be inserted in at least a lower edge of the tubular body and thereby seals the tubular body at the bottom.

The base section may have an edge area, which essentially runs parallel to the lower edge of the tubular body. The edge area serves as a sealing edge and preferably has a width extending horizontally to the circumference in the range of 0.1 mm to 10 mm, preferably 0.25 mm to 5 mm and, above all, preferably 0.4 mm to 0.6 mm.

The tubular body may be manufactured from at least a two-ply laminate, which has at least one barrier coating. In one embodiment of the invention, the layer of the laminate facing one inner side of the receptacle is constructed as a sealing layer and, in the instance of at least a three-ply laminate, a layer of the laminate facing one outer side of the receptacle is constructed as a printable and/or sealable layer. This enables the tubular body to be formed by an initially plane laminate being closed by means of a sealing seam, preferably a lap-seal seam to form a tubular body.

According to one variant of the invention, it is envisaged that the tubular body is formed from the plane laminate in such a way that a fin seal seam is constructed, preferably on at least one side of the tubular body. This fin seal seam may join without any transition a second tubular body, which is also formed by this and is arranged parallel and next to the first tubular body. In this way, it becomes possible to manufacture several tubular receptacles arranged side by side, which are connected to each other via a fin seal seam. The fin seal seam can be perforated parallel to the longitudinal extension of the tubular receptacle, so that one tubular receptacle can be separated from the one arranged adjacent to it. In this way, it is possible to realize a "six pack", for instance.

In another alternative embodiment, the tubular body is constructed to be seamless. This may be realized by extrusion. The individual layers of the laminate are preferably co-extruded according to the invention. On this occasion, tandem, one-step or triplex extrusion is possible.

The at least one barrier coating contained in the laminate may be manufactured from one or more of the following materials: polyethylene terephthalate silicon oxide (PET-SiOx), stretched polyamide (OPA-SiOx), ethylene-vinyl alcohol (EVOH), polyamide (PA), aluminum, especially aluminum foil.

The thickness of the laminate is, according to the invention, in the range of 450 μm to 800 μm, preferably in the range of 250 μm to 400 μm and, above all, preferably in the range of 150 μm to 200 μm.

The laminate according to the invention may contain one or more barrier coatings, which may be manufactured from the same material, though preferably from different materials.

In one embodiment of the invention, the closure device can be fastened on the top section, especially on a collar-shaped part of the top section, by means of mounting, screwing or clicking on. However, it is equally possible to glue the closure device on the top section or a collar-shaped part of this or to seal it with the latter. The fastening variant applied in each case depends on the desired load-bearing capacity of the connection between closure device and top section, and possibly the desired refill capacity of the receptacle. Hence it is advantageous, for instance, to attach a screw-type closure device if carbonated drinks are filled and stored in the tubular can-shaped receptacles since this guarantees both a deliberate relief of pressure and a secure seal.

In a further embodiment of the invention, the base section has a sealable and/or resealable facility, allowing the receptacle to be filled one or more times. As an alternative to this, the filling process can be carried out through the top section, preferably before the closure device is fastened on. Repeated filling through the top section may be carried out through the open closure device. Alternatively, a closure device may be used that can be mounted, screwed or clicked on to the top section and removed again in reverse fashion.

In addition, the aim according to the invention may be achieved by a method of manufacturing a tubular, especially can-shaped, receptacle for the accommodation of fluids, especially drinks, with a tubular body and a base and top section attached to this, wherein a shoulder-shaped top section is inserted in the tubular body and sealed with this in such a way that the shoulder-shaped top section is at least partially enclosed, especially in the shape of a shoulder, by an upper edge of the tubular body. The shoulder-shaped top section here may be inserted through the opening in the base of the tubular body and displaced longitudinally as far as an opening in the head of the tubular body. Alternatively, an upper edge of the tubular body may only be deformed into the shape of a shoulder when the shoulder-shaped top section has been inserted in the head of the tubular body. Such a shoulder-shaped deformation of the upper edge of the tubular body may be carried out, for instance, in the course of sealing. Sealing the shoulder-shaped top section with the upper edge of the tubular body is also carried out, of course, if the shoulder-shaped top section is inserted in the same through the opening in the base of the tubular body and displaced in the direction of the head of the tubular body.

In another embodiment of the invention, a circular base section is inserted in the tubular body and sealed with this in such a way that the circular base section is enclosed by a lower edge of the tubular body. The lower edge at least of the tubular bogy is sealed on this occasion with a sealed part of the circular base section running parallel to the edge.

The circular base section is preferably dimensionally stable, though it may also be constructed to be flexible. A dimensionally stable construction here guarantees, in an advantageous manner, a stable standing surface for the tubular receptacle. The advantage of a flexible construction to the circular base section, in contrast, consists in an improved ability to be folded up and disposed of when the receptacle is empty and has to be discarded.

The tubular body may be manufactured from a laminate that has at least one barrier coating, which may consist of the aforementioned materials. Depending on the requirement, several barrier coatings may also be arranged in the laminate.

In another embodiment of the invention, the tubular body is manufactured by means of extrusion. This enables a seamless manufacture of the tubular body and thus greater firmness. The preferred manufacture of the tubular body is as a lap-seal sealed laminate, wherein the sequence of layers of the laminate is as follows: sealing layer/barrier coating/sealing layer. Polyethylene (PE) or polypropylene (PP) or similar sealable materials are preferably used for the sealing layer.

A printing of the tubular receptacle may be carried out on the outer sealing layer or on a transparent barrier coating, such as a barrier containing polyethylene terephthalate.

Hence, embodiments of the tubular receptacle are suitable for filling and storing as well as transporting fluids, especially still drinks or slight to minimally carbonated drinks. The tubular receptacle can be sterilized or pasteurized. Filling can be carried out through the open base and subsequent sealing or through an opening in the base or through the shoulder-shaped top section.

In addition, the aim of the invention is achieved by the use of a tubular, especially can-shaped, receptacle consisting of at least one tubular body and a base and shoulder-shaped top section attached to this for fluids that are under slight excess pressure, especially carbonated drinks.

BRIEF DESCRIPTION OF THE FIGURES

Below the invention is described from one embodiment example, which is explained in more detail from the FIGURE.

DETAILED DESCRIPTION

Figure 1:
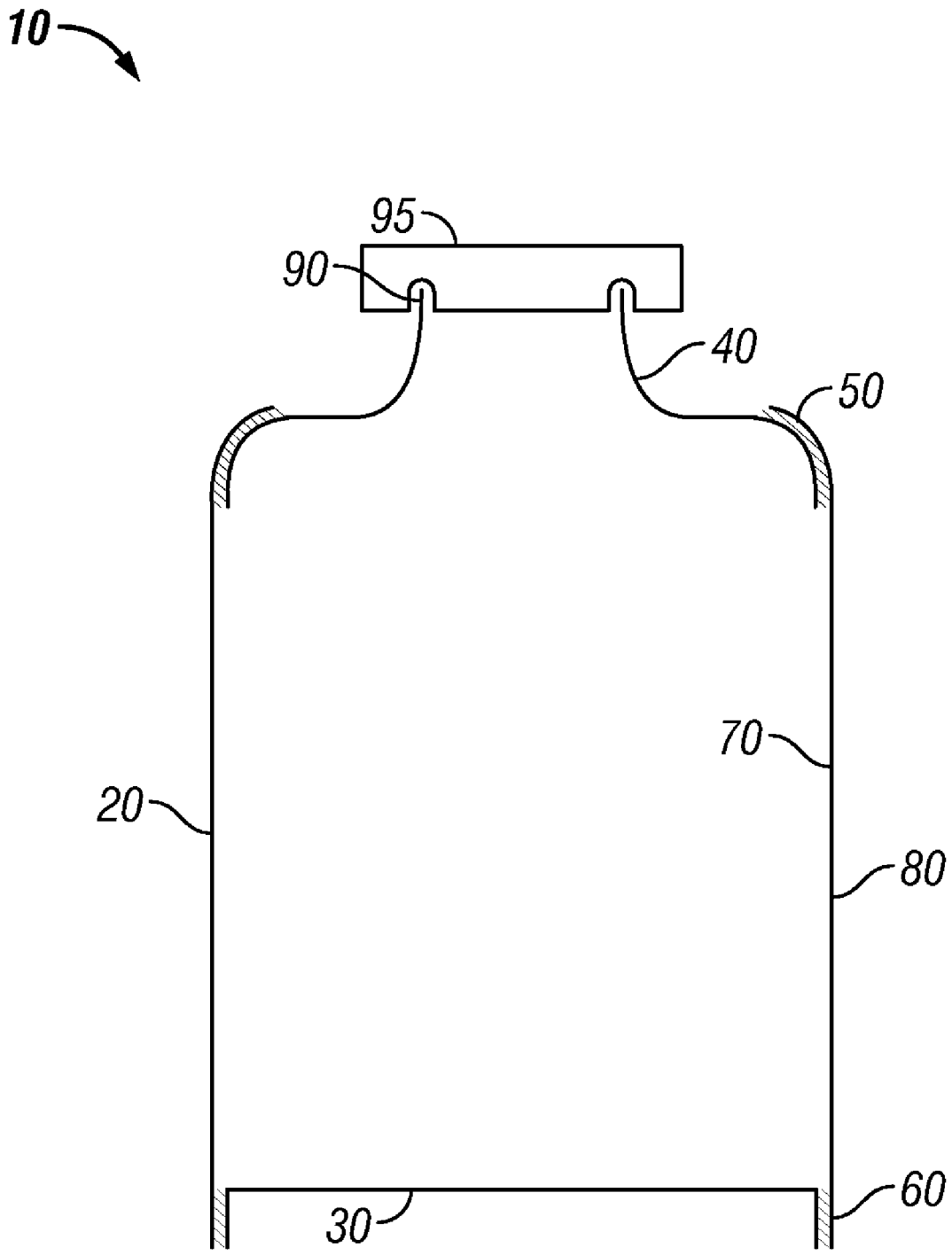
FIG. 1: A schematic representation of a tubular receptacle according to the invention according to a preferred embodiment

In the following description the same reference numerals are used for the same and similarly acting parts.

FIG. 1 depicts a tubular receptacle 10. The tubular receptacle has a tubular body 20 and a base section 30 and a shoulder-shaped top section 40. The base 30 is inserted in the tubular body 20 from below and is sealed along a lower edge 60 with the tubular body 20. In the head of the tubular body 20 the shoulder-shaped top section 40 with a collar-shaped part 90 is located. The shoulder-shaped top section 40 is sealed with an upper edge 50 of the tubular body 20. The upper edge 50 encloses the shoulder-shaped top section 40 in the shape of a shoulder. The tubular body 20 is manufactured from a laminate, which has a barrier coating (not depicted). The layer 70 of the laminate facing the inside of the receptacle consists of polyethylene. The layer 80 of the laminate facing the outside of the receptacle also consists of this material. The same layer structure applies to the base section as to the shoulder-shaped top section 40. In this way it is guaranteed that the outer layers of the laminate consist of a sealable material and, as a result, that the base section 30 and the top section 40 can be inserted in the tubular body 20. A closure device 95 can be fastened to the collar-shaped part 90 of the tubular receptacle 10.

FIG. 1 depicts a tubular receptacle 10. The tubular receptacle has a tubular body 20 and a base section 30 and a shoulder-shaped top section 40. The base 30 is inserted in the tubular body 20 from below and is sealed along a lower edge 60 with the tubular body 20. In the head of the tubular body 20 the shoulder-shaped top section 40 with a collar-shaped part 90 is located. The shoulder-shaped top section 40 is sealed with an upper edge 50 of the tubular body 20. The upper edge 50 encloses the shoulder-shaped top section 40 in the shape of a shoulder. The tubular body 20 is manufactured from a laminate, which has a barrier coating (not depicted). The layer 70 of the laminate facing the inside of the receptacle consists of polyethylene. The layer 80 of the laminate facing the outside of the receptacle also consists of this material. The same layer structure applies to the base section as to the shoulder-shaped top section 40. In this way it is guaranteed that the outer layers of the laminate consist of a sealable material and, as a result, that the base section 30 and the top section 40 can be inserted in the tubular body 20. A closure device 95 can be fastened to the collar-shaped part 90 of the tubular receptacle 10.

FIG. 1 depicts a tubular receptacle 10. The tubular receptacle has a tubular body 20 and a base section 30 and a shoulder-shaped top section 40. The base 30 is inserted in the tubular body 20 from below and is sealed along a lower edge 60 with the tubular body 20. In the head of the tubular body 20 the shoulder-shaped top section 40 with a collar-shaped part 90 is located. The shoulder-shaped top section 40 is sealed with an upper edge 50 of the tubular body 20. The upper edge 50 encloses the shoulder-shaped top section 40 in the shape of a shoulder. The tubular body 20 is manufactured from a laminate, which has a barrier coating (not depicted). The layer 70 of the laminate facing the inside of the receptacle consists of polyethylene. The layer 80 of the laminate facing the outside of the receptacle also consists of this material. The same layer structure applies to the base section as to the shoulder-shaped top section 40. In this way it is guaranteed that the outer layers of the laminate consist of a sealable material and, as a result, that the base section 30 and the top section 40 can be inserted in the tubular body 20. A closure device 95 can be fastened to the collar-shaped part 90 of the tubular receptacle 10.

FIG. 1 depicts a tubular receptacle 10. The tubular receptacle has a tubular body 20 and a base section 30 and a shoulder-shaped top section 40. The base 30 is inserted in the tubular body 20 from below and is sealed along a lower edge 60 with the tubular body 20. In the head of the tubular body 20 the shoulder-shaped top section 40 with a collar-shaped part 90 is located. The shoulder-shaped top section 40 is sealed with an upper edge 50 of the tubular body 20. The upper edge 50 encloses the shoulder-shaped top section 40 in the shape of a shoulder. The tubular body 20 is manufactured from a laminate, which has a barrier coating (not depicted). The layer 70 of the laminate facing the inside of the receptacle consists of polyethylene. The layer 80 of the laminate facing the outside of the receptacle also consists of this material. The same layer structure applies to the base section as to the shoulder-shaped top section 40. In this way it is guaranteed that the outer layers of the laminate consist of a sealable material and, as a result, that the base section 30 and the top section 40 can be inserted in the tubular body 20. A closure device 95 can be fastened to the collar-shaped part 90 of the tubular receptacle 10.

At this point it should be pointed out that all the parts described above have been claimed for themselves alone and in any combination, especially the details described in the drawing. Revisions to this are familiar to the man skilled in the art.

LIST OF REFERENCE NUMERALS

10 tubular receptacle
20 tubular body
30 base section
40 top section
50 upper edge
60 lower edge
70 layer of laminate facing the inside of the receptacle
80 layer of laminate facing the outside of the receptacle
90 collar-shaped part

What is claimed is:

1. A method of manufacturing a tubular receptacle for the accommodation of fluids comprising a tubular body having unfolded ends, an upper end being deformed in a shape of a shoulder and a lower end being straightly extending, the receptacle being manufactured from a flexible laminate and a base and a shoulder-shaped top section attached to the tubular body, the method comprising inserting the shoulder-shaped top section in the unfolded tubular body from the lower end until at least a portion of the shoulder-shaped top section is pressed against the shoulder of the tubular body, and sealing the shoulder-shaped top section with the upper end by a lap seam such that the shoulder-shaped top section is at least partially enclosed by the upper end of the tubular body, wherein the base comprises an edge area forming a sealing edge having a width extending horizontally to the circumference of 0.25 mm to 5 mm, and wherein a lower edge of the tubular body surrounds and is sealed to the edge area of the base by another lap seam that does not extend past the edge area of the base.

2. A method according to claim 1, comprising inserting a circular-shaped base section in the unfolded lower end of the tubular body and sealing the circular-shaped base section with the tubular body such that the circular-shaped base section is enclosed by the unfolded lower end of the tubular body.

3. A method according to claim 1, wherein the laminate has at least one barrier coating, the barrier coating comprising one or more of the following materials: polyethylene terephthalate silicon oxide (PET-SiOx), stretched polyamide (OPA-SiOx), ethylene-vinyl alcohol (EVOH), and polyamide (PA) aluminum (Al).

4. A method according to claim 1, wherein the tubular body has been manufactured by extrusion.

5. A method of manufacturing a tubular receptacle for the accommodation of fluids, the method comprising:

inserting a shoulder-shaped top section into a lower end of an tubular body until at least a portion of the shoulder-shaped top section is pressed flat against an upper end of the tubular body formed in the shape of a shoulder, wherein the shoulder-shaped top section comprises an opening at an upper portion thereof, the lower end of the tubular body being unfolded so as to form a circumferential standing surface;

sealing the shoulder-shaped top section directly to the upper end of the tubular body using a lap seam such that the shoulder-shaped top section is in contact with the upper end of the tubular body and no materials are intermediary therebetween, wherein a portion of the shoulder-shaped top section is enclosed by the upper end and a portion of the shoulder-shaped top section protrudes through an opening in the upper end;

inserting a dimensionally stable base section into the unfolded lower end of the tubular body such that the base section is enclosed by the unfolded lower end of the tubular body, the base section having a shape that is adapted to a shape of the standing surface and having a an edge area that extends substantially horizontal to a circumference of the shape; and sealing the unfolded lower end of the tubular body to the edge area of the base section such that the unfolded lower end is disposed substantially parallel to the edge area, wherein the tubular body, and wherein the edge area of the base forms a sealing edge having a width extending horizontally to the circumference of 0.25 mm to 5 mm and a lower edge of the tubular body surrounds and is sealed to the edge area of the base by another lap seam that does not extend past the edge area of the base is manufactured from a flexible laminate.

6. The method of claim 5, wherein the base section is circular shaped.

7. The method of claim 5, wherein the laminate has at least one barrier coating, the barrier coating comprising one or more of the following materials:

polyethylene terephthalate silicon oxide (PET-SiOx), stretched polyamide (OPA-SiOx), ethylene-vinyl alcohol (EVOH), and polyamide (PA) aluminum (Al).

8. The method of claim 5, wherein the tubular body comprises an extruded tubular body.

* * * * *

UNITED STATES PATENT AND TRADEMARK OFFICE

CERTIFICATE OF CORRECTION

PATENT NO. : 8,056,209 B2
APPLICATION NO. : 12/099730
DATED : November 15, 2011
INVENTOR(S) : Andreas Michalsky It is certified that error appears in the above-identified patent and that said Letters Patent is hereby corrected as shown below:

On the title page, please change (item 73) "Assignee: Zweigniederlassung der Huhtamaki Deutschland, GmbH & Co. KG" to --Assignee: Huhtamaki Ronsberg, Zweigniederlassung der Huhtamaki Deutschland GmbH & Co. KG--.

Signed and Sealed this
Thirteenth Day of March, 2012

David J. Kappos

David J. Kappos
*Director of the United States Patent and Trademark Office*